United States Patent [19]

Zipperian et al.

[11] 4,040,950

[45] Aug. 9, 1977

[54] CONCENTRATION OF ORE BY FLOTATION WITH SOLUTIONS OF AQUEOUS DITHIOPHOSPHATES AND THIONOCARBAMATE AS COLLECTOR

[75] Inventors: Donald Edwin Zipperian; James Allen Jones; Thomas Brian Buza, all of Tuscon, Ariz.

[73] Assignee: American Cyanamid Company, Stamford, Conn.

[21] Appl. No.: 584,685

[22] Filed: June 6, 1975

Related U.S. Application Data

[62] Division of Ser. No. 493,946, Aug. 1, 1974, Pat. No. 3,925,218.

[51] Int. Cl.[2] ..... B03D 1/02

[52] U.S. Cl. ..... 209/166

[58] Field of Search ..... 209/166, 167

[56] References Cited

U.S. PATENT DOCUMENTS

| | | | |
|---|---|---|---|
| 1,893,018 | 1/1933 | Christmann | 209/166 X |
| 2,691,635 | 10/1951 | Harris | 209/166 X |
| 3,086,653 | 4/1963 | Booth | 209/167 X |
| 3,426,896 | 2/1969 | Baarson | 209/167 |
| 3,595,390 | 7/1971 | Booth | 209/166 |

*Primary Examiner*—Robert Halper

*Attorney, Agent, or Firm*—John L. Sullivan; William J. vanLoo

[57] ABSTRACT

A process for flotation of copper sulfide values from copper bearing ores wherein a collector that comprises an aqueous solution of a salt of a dialkyl thiophosphate and an N-alkyl O-alkyl thionocarbamate dissolved therein, is employed.

5 Claims, 3 Drawing Figures

Figure 1:
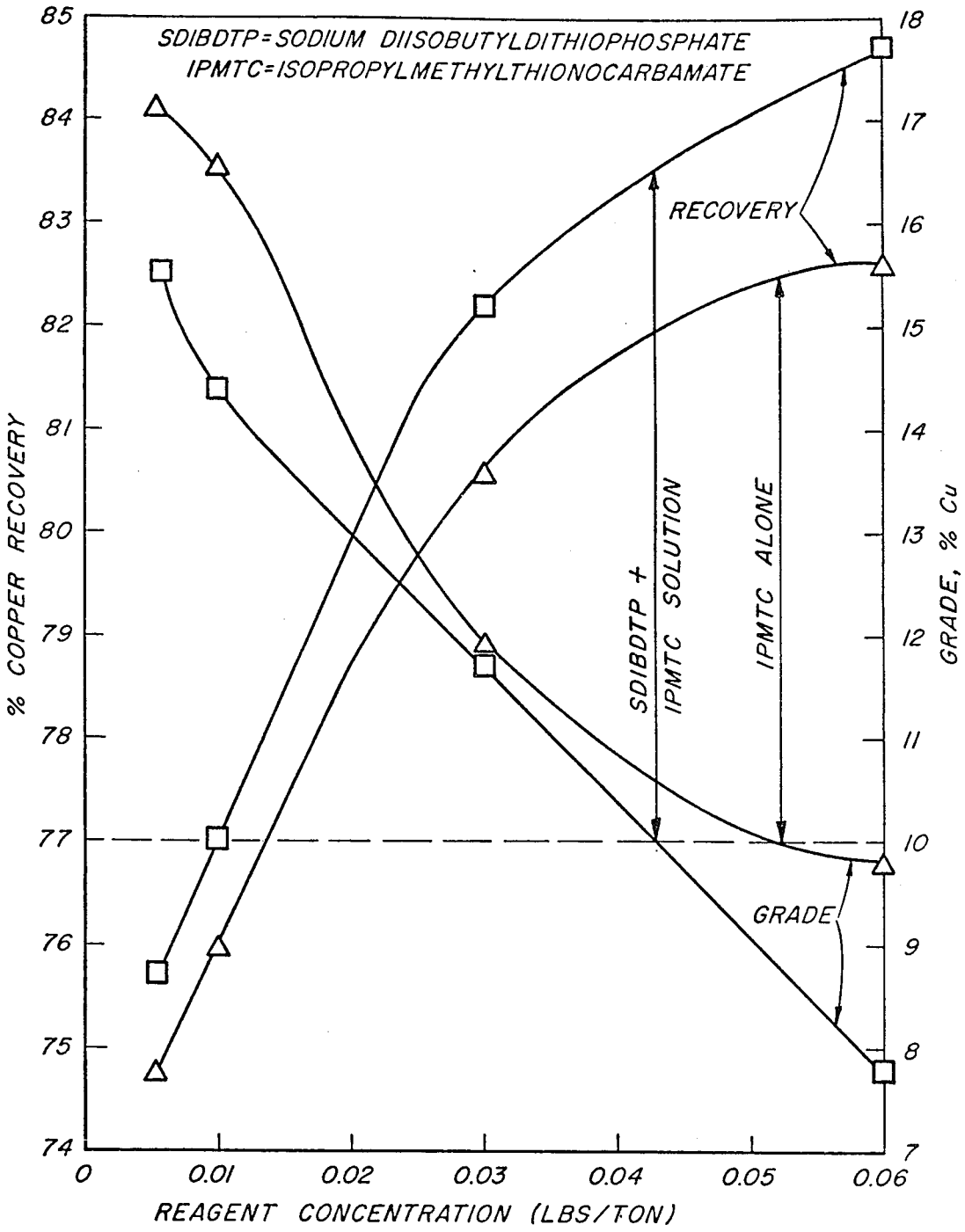

CONCENTRATION OF ORE BY FLOTATION WITH SOLUTIONS OF AQUEOUS DITHIOPHOSPHATES AND THIONOCARBAMATE AS COLLECTOR

This is a division, of application Ser. No. 493,946, filed Aug. 1, 1974 and now U.S. Pat. No. 3,925,218 issued Dec. 9, 1975.

This invention relates to a novel composition of matter comprising an aqueous dialkyl dithiophosphate solution containing dissolved therein an N-alkyl, O-alkyl thionocarbamate.

Organic sulfur compounds are numerous and of highly varied structure. Such compounds have a variety of uses depending on their nature and properties. Typically, organic sulfur compounds are used in the manufacture of rayon and cellophane, as insecticides, as fungicides and as flotation agents in the concentration of minerals. Certain organic sulfur compounds are water soluble while others are not. The lack of water solubility in many cases interferes with extensive utilization of such organic sulfur compounds. In many applications, it is desirable to use mixtures of different types of sulfur compounds for increased efficiency. However, the incompatibility of different types of sulfur compounds and the lack of water solubility of specific sulfur compounds complicates efforts to use mixtures of different types of organic sulfur compounds. This generally necessitates separate additions of the different types of sulfur compounds to be employed and extensive processing to effect uniform admixture. In many instances, maximum performance of the mixture is not obtained because of the incompatibility of the different sulfur compounds.

Alkali metal or ammonium salts of dialkyl dithiophosphates are water soluble organic sulfur compounds that have been used for many years as flotation agents in the concentration of minerals. N-alkyl, O-alkyl thionocarbamates are water insoluble oils that also have typical uses of organic sulfur compounds, such as flotation agents in the concentration of minerals. The dissimilar solubility characteristics of these different compound types do not suggest that these compounds could be employed as a single composition.

In accordance with the present invention, there is provided a stable aqueous solution comprising from about 35 to 50 weight percent of an alkali metal or ammonium salt of a dialkyldithiophosphate and, correspondingly, from about 65 to 50 weight percent of water, said solution containing dissolved therein sufficient of an N-alkyl, O-alkyl thionocarbamate to provide a volume ratio in the range of from about 5:95 to 95:5 of said dialkyl dithiophosphate salt solution to said thionocarbamate, respectively.

The solubility of N-alkyl, O-alkyl thionocarbamates in aqueous solutions of alkali metal or ammonium salts of dialkyldithiophosphates is highly unexpected for numerous reasons. The N-alkyl, O-alkyl thionocarbamates are insoluble in aqueous solutions of alkali metal alkyl xanthantes. The thiophosphates are insoluble in allyl amyl xanthate, a water insoluble oil similar in nature and application to the thionocarbamates. Toluene, an organic solvent, was found to be immiscible with the aqueous dithiophosphates in proportions in which the thionocarbamates are miscible. The range of proportions at which the various thionocarbamates are miscible with the aqueous dithiophosphates varies with the individual compounds of both types.

In accordance with the process aspect of the present invention, there is provided an improvement in the process of recovering copper values from a copper-bearing ore by froth flotation which comprises using as collector for said copper values an aqueous solution comprising from about 35 to 50 weight percent of an alkali metal or ammonium salt of a dialkyl dithiophosphate and, correspondingly, from about 65 to 50 weight percent of water, said solution containing dissolved therein sufficient of an N alkyl O-alkyl thionocarbamate to provide a volume ratio in the range of about 5:95 to 95:5 of said dialkyl dithiophosphate salt solution to said thionocarbamate, respectively, said collector being used at from about 0.001 to about 0.1 pounds per ton of ore.

The alkali metal or ammonium salts of the dialkyl dithophosphoric acids useful in the present invention have the general formula

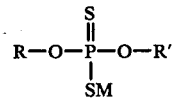

wherein M is an alkali metal or ammonium ion and R and R′ are individually selected from alkyl groups of 2 to 8 carbon atoms having straight or branched chains. Typical compounds include sodium diethyldithiophosphate, sodium diisopropyldithiophosphate, sodium diisobutyldithiophosphate, sodium diisoamyldithiophosphate, 0,0-bis(1,3-dimethylbutyl)sodium phosphorodithioate and the corresponding compounds as the ammonium or potassium salts. Alternatively, the acid may be called phosphorodithionic acid, the esters identified as 0,0-esters, and the salt indicated. All of the dithiophosphates contemplated for use in the present invention are water soluble.

The thionocarbonamates useful in the present invention have the structure:

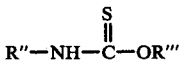

wherein R″ and R‴are individually sclected from alkyl groups of about 1 to 6 carbon atoms having straight or branched chains. Typical compounds include isopropyl methylthionocarbamate, isopropyl ethylthionocarbamate, isobutyl methylthionocarbamate and the like. The first alkyl radical named in the nomenclature is attached to the oxygen atom and the second is attached to the nitrogen atom. Thus, the alkylthionocarbamic acid is identified and the ester thereof is specified by the first alkyl radical named. The compounds are sometimes called thioncarbamates but for euphony the thionocarbamate designation is preferred. All of the thiononcarbamates contemplated for use in the invention are water insoluble oils.

In preparing the compositions of the present invention, an aqueous solution of the dialkyldithiophosphate salt is prepared. Generally such salt will be prepared as about a 35 to 70 weight percent aqueous solution, depending upon the solubility limit of the particular dialkyldithiophosphate salt employed. Solubility of the thionocarbamate is predicated on the dialkyldithiophosphate salt solution being concentrated, generally at least about 25 weight percent.

In preparing the compositions of the invention, the oily, water insoluble, thionocarbamate is mixed with the concentrated aqueous dialkyldithiophosphate salt until solution occurs. The amount of thionocarbamate used in the mixture in preparing the composition will generally be in a range such as to provide a volume ratio of from about 5:95 to 95:5 of said dialkyldithiophosphate salt solution to said thionocarbamate, respectively. The individual thionocarbamates vary in solubility in aqueous solutions of particular dialkyldithiophosphate salts and, accordingly, varying maximum contents of thionocarbamates in the composition will arise. Table I which follows, indicates solubility values of selected thionocarbamates in certain dialkyldithiophosphate salt solutions.

TABLE I

Solubility of Certain Thionocarbamates In Aqueous Dialkyldithiophosphate Salt Solutions
Volume Ratio Dithiophosphate Salt Solution to Thionocarbamate

| Dithiophosphate Salt | Salt Conc. (%) | THIONOCARBAMATE Isopropyl Methyl | Isopropyl Ethyl | Isobutyl Methyl |
|---|---|---|---|---|
| Sodium O, O-bis(1,3-dimethylbutyl) | 35 | 40:60 | 70:30 | 40:60 |
| Sodium diisoamyl | 35 | 40:60 | 70:30 | 40:60 |
| Sodium diisobutyl | 50 | 50:50 | 60:40 | 40:60 |
| Sodium diisopropyl | 50 | 40:60 | 60:40 | 60:40 |
| Sodium diethyl | 50 | 90:10 | 90:10 | 90:10 |

It is generally preferred to prepare the solutions at or near the levels of maximum solubility of the dialkydithiophosphate salt and to add thereto the requisite weight ratio of thionocarbamate which is desirable in the specific application in which use is contemplated. Thus, the high concentration of dialkyldithiophosphate salt minimizes shipping costs and the desired level of thionocarbamate minimizes handling, requiring only dilution for use.

The compositions of the present invention eliminate the need for separate additions of the two ingredients when co-use thereof is desirable, thus reducing the number of processing steps normally required for co-use. The compositions also provide the thionocarbamates in desirable form for addition, in aqueous solution form, a form previously not available. The aqueous solution form is desirable in many applications where it is compatible in the process being performed and thus eliminates the problems associated with uniformly dispersing the normal oily, water insoluble, thionocarbamates. In certain instances, the compositions of the invention provide improved performance over the separate use of either of specific ingredient alone or over the separate but simultaneous addition of both individual ingredients. Thus, not only do the compositions of the present invention eliminate processing steps and handling difficulties normally associated with uses of thionocarbamates, but also may provide improved performance in certain applications while eliminating such prior problems.

A particular application in which the solutions of the present invention show advantage is that of collector in concentrating valuable constituents from ores by flotation. The mixed solution of thionocarbamate and dialkyldithiophosphate provides advantages in the flotation of metallic sulfides such as those of copper, zinc, lead, platinum, nickel and molybdenum ores. The advantages include reduction in processing steps by use of the combined solution and may provide increased recovery of desired metal values while maintaining a high grade concentrate.

The collector is used in an amount which will provide best recovery of metal while maintaining a high grade of metal. Generally, this amount will vary from about 0.001 to about 0.1 pound of collector per ton of ore, preferably about 0.005 to about 0.05 pound per ton. Usage will vary depending upon the particular ore processed, the composition of the collector solution, and the processing equipment employed. Optimum usage can be readily determined by trial.

The invention is illustrated by the examples which follow wherein all parts and percentages are by weight unless otherwise specified.

EXAMPLES 1–12

A series of solutions was prepared employing the following ingredients.

1. isopropyl methylthionocarbamate
2. isobutyl methylthionocarbamate
3. sodium diisoamyldithiophosphate Compounds 1 and 2 were in the form of oils without diluents while compound 3 was in the form of an aqueous 35% solution. The compounds 1 and 2 were mixed in separate examples with the solution of compound 3 at volume ratios of from 80/20 to 20/80 of thionocarbamate to dithiophosphate solution. The examples run are as follows:

| Example | Volume Ratio (25° C.) 1 | 2 | 3 | 4 | 5 | 6 |
|---|---|---|---|---|---|---|
| Compound 1 | 20 | 30 | 40 | 60 | 70 | 80 |
| Compound 3 | 80 | 70 | 60 | 40 | 30 | 20 |
| Example | 7 | 8 | 9 | 10 | 11 | 12 |
| Compound 2 | 20 | 30 | 40 | 60 | 70 | 80 |
| Compound 3 | 80 | 70 | 60 | 40 | 30 | 20 |

In each example, a stable solution resulted in which the thionocarbamate was completely dissolved.

EXAMPLES 13–32

A series of solutions was again prepared employing the following ingredients:

1. isopropyl methylthionocarbamate
2. isobutyl methylthionocarbamate
5. sodium diisopropyldithiophosphate
6. sodium 0,0-bis(1,3-dimethylbutyl)dithiophosphate
7. sodium diisobutyl dithiophosphate Compounds 1 and 2 were in the form of oils without diluents while compound 6 was in the form of an aqueous 35% solution and compounds 5 and 7 were in the form of aqueous 50% solutions. The examples run are as follows:

| | Volume Ratio (25° C.) | | | | |
|---|---|---|---|---|---|
| Example | 13 | 14 | 15 | 16 | 17 |
| Compound 5 | 30 | 40 | 60 | 70 | 80 |
| Compound 1 | 70 | 60 | 40 | 30 | 20 |
| Example | 18 | 19 | 20 | 21 | 22 |
| Compound 6 | 30 | 40 | 60 | 70 | 80 |
| Compound 1 | 70 | 60 | 40 | 30 | 20 |
| Example | 23 | 24 | 25 | 26 | 27 |
| Compound 6 | 30 | 40 | 60 | 70 | 80 |
| Compound 2 | 70 | 60 | 40 | 30 | 20 |
| Example | 28 | 29 | 30 | 31 | 32 |
| Compound 7 | 30 | 40 | 60 | 70 | 80 |
| Compound 1 | 70 | 60 | 40 | 30 | 20 |

In each example, a stable solution resulted in which the thionocarbamate was completely dissolved.

EXAMPLES 33–36

A series of solutions was prepared employing the following ingredients.

2. isobutyl methylthionocarbamate
7. sodium diisobutyldithiophosphate

Compound 2 was in the form of an oil without diluents while compound 7 was in the form of a 50% aqueous solution. The examples run were as follows:

| | Volume Ratio (25° C.) | | | |
|---|---|---|---|---|
| Example | 33 | 34 | 35 | 36 |
| Compound 7 | 40 | 60 | 70 | 80 |
| Compound 2 | 60 | 40 | 30 | 20 |

In each example, a stable solution resulted in which the thionocarbamate was completely dissolved.

EXAMPLES 37–40

A series of solutions was prepared employing the following ingredients.

4. isopropyl ethylthionocarbamate
5. sodium diisopropyldithiophosphate
7. sodium diisobutyldithiophosphate Compound 4 was in the form of an oil without diluents while compounds 5 and 7 were in the form of aqueous 50% solutions. The examples run were as follows:

| | Volume Ratio (25° C.) | |
|---|---|---|
| Example | 37 | 38 |
| Compound 5 | 70 | 80 |
| Compound 4 | 30 | 20 |
| Example | 39 | 40 |
| Compound 7 | 70 | 80 |
| Compound 4 | 30 | 20 |

In each example, a stable solution resulted in which the thionocarbamate was completely dissolved.

EXAMPLE 41

In this example a volume ratio (25° C.) of 20/80 of compound 4 of the previous example and of compound 3 of Example 1, respectively, was prepared. A stable solution resulted in which the thionocarbamate was completely dissolved.

COMPARATIVE EXAMPLE A

Attempts were made to prepare solutions of thionocarbamates in xanthate solutions. The following ingredients were employed.

XANTHATES

Sodium ethyl xanthate — 50% aqueous
Sodium isobutyl xanthate — 50% aqueous
Potassium Amyl xanthate — 50% aqueous

Thionocarbamates

Isopropyl methylthionocarbamate
Isopropyl ethylthionocarbamate
Isobutyl methylthionocarbamate
(All thionocarbamates were oils without diluents.)

Mixtures of all xanthate solutions with all thionocarbamates at volume ratios of 40/60 to 70/30 respectively at 25° C. gave two phase compositions, i.e. solution of the thionocarbamates in the aqueous xanthates did not result.

COMPARATIVE EXAMPLE B

Attempts were made to prepare solutions of allyl amyl xanthate (a water-insoluble oil) in the following:

Sodium diisopropyldithiophosphate — 50% aqueous
Sodium 0,0-bis(1,3-dimethylbutyl)dithiophosphate 35%—aqueous
Sodium diisobutyldithiophosphate — 50% aqueous
Sodium diisoamyldithiophosphate — 35% aqueous Volume ratios of 60/40 to 30/70 of the xanthate to the dithiophosphate solution, respectively, at 25° C. were prepared in separate runs. In each run, two phases were obtained, i.e. solution of the xanthate in the aqueous dithiophosphate solution was not obtained.

COMPARATIVE EXAMPLE C

The procedure of Comparative Example B was again followed except that toluene was substituted for the xanthate employed in Comparative Example B. At volume ratios from 60/40 to 30/70, respectively, of toluene to dithiophosphate solution, two phases were obtained.

EXAMPLES 42–44

Sodium diethyldithiophosphate as an aqueous 50% solution was employed as solvent medium for the following three thionocarbamates in the form of oils without diluents:

isopropyl methylthionocarbamate
isopropyl ethylthionocarbamate
isobutyl methylthionocarbamate The solubility limit in weight % of each of thionocarbamates in the dithiophosphate solution at 25° C. was determined. Results are as follows:

| Example | Thionocarbamate | Weight (%) |
|---|---|---|
| 42 | isopropyl methyl- | 5 |
| 43 | isopropyl ethyl- | 4 |
| 44 | isobutyl methyl- | 5 |

EXAMPLE 45

A crushed and ground sample of ore containing 0.6% copper (primarily chalcocite) was submitted to the conventional laboratory flotation procedure using various collectors at varying usage levels. Minimum acceptable rougher concentrate that can be upgraded to final concentrate grade in the existing plant equipment for this ore was 10% Cu. The collectors employed, the usage levels run, and the results obtained are given in Table II which follows.

TABLE II

| COLLECTOR | COPPER RECOVERY USAGE LBS./TON[1] | CONCEN-TRATE WEIGHT % | COPPER RECOVERY % | GRADE % Cu |
|---|---|---|---|---|
| Isopropyl Methylthionocarbamate[2] | 0.006 | 2.53 | 74.8 | 17.11 |
| " | 0.010 | 2.59 | 76.0 | 16.56 |
| " | 0.030 | 4.01 | 80.6 | 11.90 |
| " | 0.060 | 5.01 | 82.6 | 9.82 |
| Na Diisobutyldithiophosphate[4] | 0.006 | 2.83 | 77.0 | 16.06 |
| " | 0.010 | 3.18 | 78.0 | 15.12 |
| " | 0.030 | 4.13 | 80.0 | 11.16 |
| " | 0.060 | 6.93 | 84.6 | 7.39 |
| Isopropyl Methylthionocarbamate[2] Plus Na Diisobutyldithiophosphate[3] [4] 50:50 Separate Additions | 0.006 | 3.06 | 80.7 | 15.92 |
| | 0.010 | 3.18 | 79.9 | 14.48 |
| | 0.030 | 4.65 | 80.8 | 10.31 |
| | 0.060 | 6.59 | 81.8 | 7.64 |
| Isopropyl Methylthionocarbamate Plus Na Diisobutyldithiophosphate [4] 50:50 Added as Single Aqueous Solution | 0.006 | 2.92 | 75.7 | 15.57 |
| | 0.010 | 3.15 | 77.0 | 14.43 |
| | 0.030 | 4.51 | 82.2 | 11.75 |
| | 0.060 | 6.66 | 84.7 | 7.78 |

[1]Pounds of Collector Per Ton of Ore
[2]Added as Oil Without Pre-Dilution
[3]Added as Aqueous Solution
[4]50% aqueous Soln The various results of copper recovery and copper grade were plotted to show the advantages of the solution of the present invention in the flotation process.

FIG. 1 shows a comparison of performance of isopropyl methylthionocarbamate alone against the use of an equal total amount of isopropyl methylthionocarbamate and sodium diisobutyldithiophosphate at 50:50 ratio in the form of an aqueous solution of the present invention. The optimum use level of isopropyl methylthionocarbamate alone is about 0.0525 pounds per ton or ore and yields a maximum recovery of copper of about 82.5% while providing a grade of copper at or above 10%. The solution of the invention has an optimum use level of about 0.043 lbs./ton while providing a maximum copper recovery of about 83.7% at a grade of copper at or above 10%.

Figure 2:
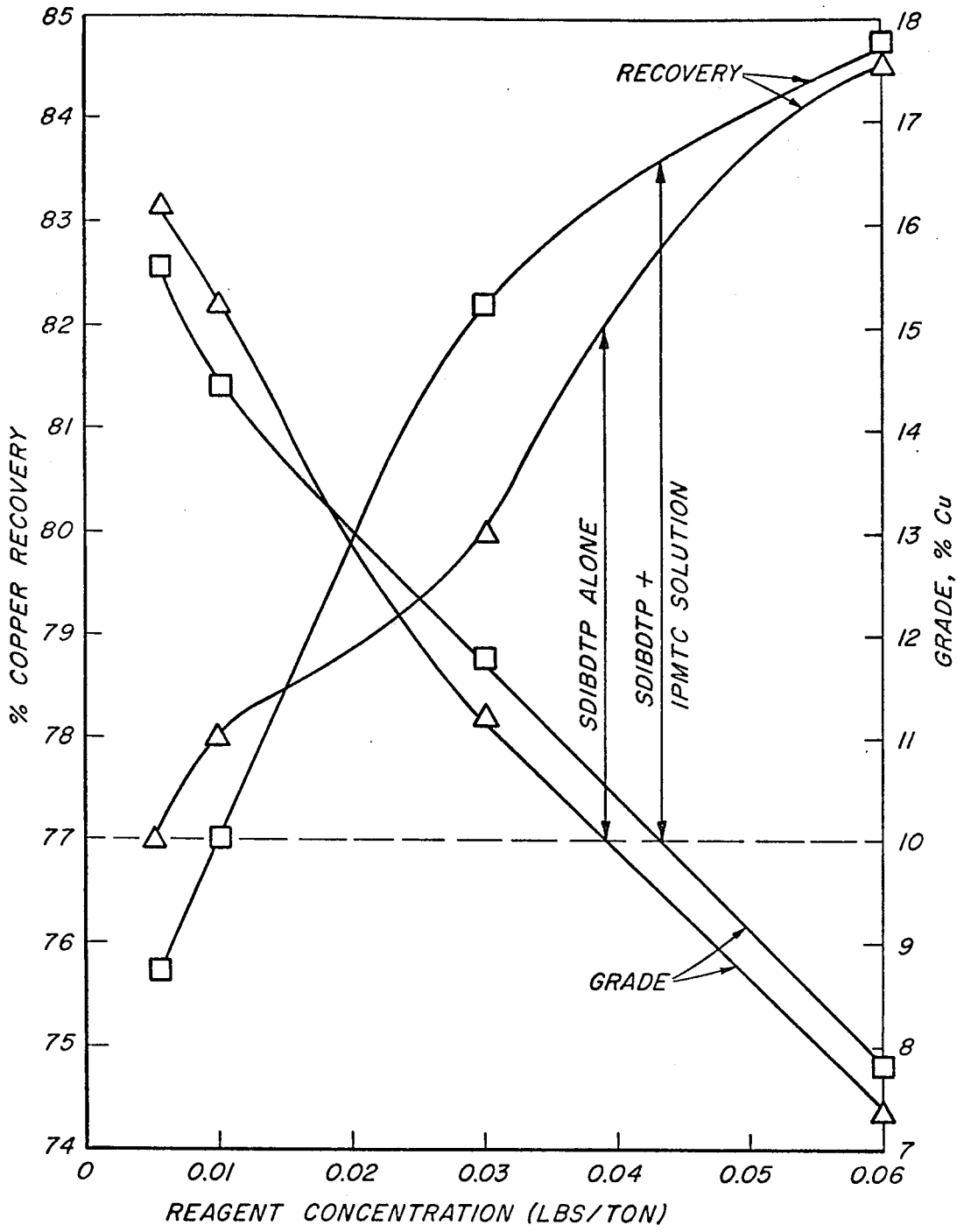

FIG. 2 shows a comparison of performances of sodium diisobutyldithiophosphate alone against the same solution of the invention described in conjunction with FIG. 1. The optimum use level of sodium diisobutyldithiophosphate alone is about 0.039 lbs./tons and yields a maximum recovery of copper of about 82% while providing a grade of copper at or above 10%. Results with the solution of the invention are as described in conjunction with FIG. 1.

Figure 3:
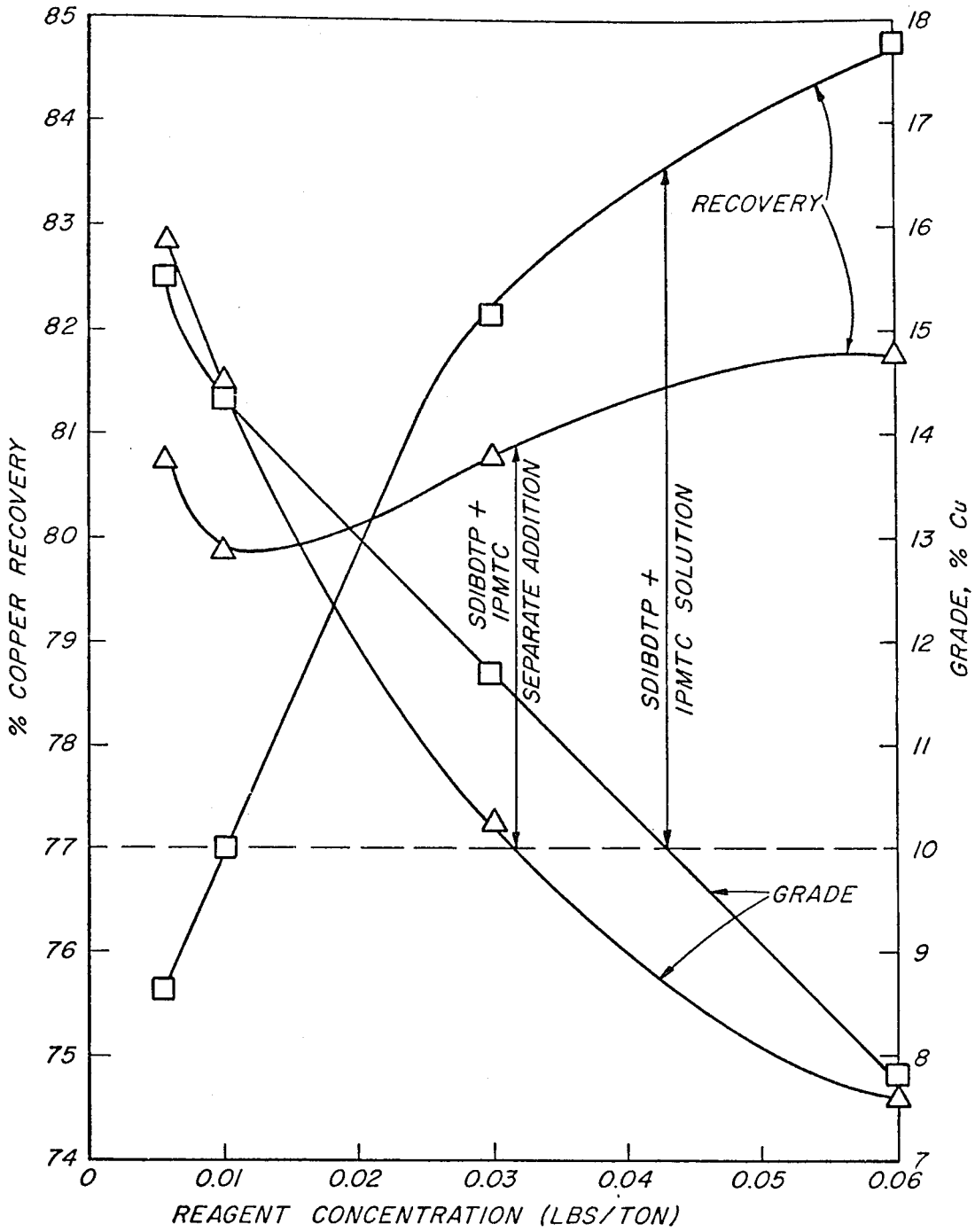

FIG. 3 shows a comparison of performance of separate additions of sodium diisobutyldithiophosphate, as an aqueous solution, and of isopropyl methylthionocarbamate, as an oil without diluents, at a ratio of 50:50 of the two ingredients against the solution of the invention described in conjunction with FIG. 1. The optimum use level of the two ingredients added separately was about 0.032 lbs./tons and yields a maximum recovery of copper of about 80.9% while providing a grade of copper at or above 10%. Results with the solution of the invention are as described in conjunction with FIG. 1.

In the case of performance of the solution of the invention against the thionocarbamate alone, the solution of the invention provides a higher copper recovery at the minimum acceptable copper grade at lower effective use level than can be obtained with the thionocarbamate alone, as shown by FIG. 1.

In the case of the performance of the solution of the invention against the dithiophosphate alone, the solution of the invention provides a higher copper recovery at the minimum copper grade acceptable, as shown in FIG. 2.

In the case of the performance of the solution of the invention against separate additions of the two ingredients, the solution of the present invention provides a higher copper recovery at the minimum copper grade acceptable as shown in FIG. 3.

Comparing the performance of the separate additions of the two ingredients (FIG. 3) with the use of the thionocarbamate alone (FIG. 1), it is seen that better results are obtained with the thionocarbamate alone. Similarly, comparing the performance of the separate additions of the two ingredients (FIG. 3) with the use of the dithiophosphate alone (FIG. 2), it is seen that better results are obtained with the dithiophosphate alone. Thus, the combination in aqueous solution therefore is superior in performance to the other additives employed. This is an added unexpected feature of the invention.

EXAMPLE 46

A copper/molybdenum ore assaying 0.4% Cu and 0.04% Mo was crushed and ground with water to flotation size. This ore pulp was then charged to a laboratory flotation machine and adjusted to pH 10.8 with lime. The ore was then conditioned for 1 minute with a collector. A mixture of methyl isobutyl carbinol nd six- and eight- carbon alcohols in a total amount of 0.06 lbs. per ton of ore was used as frothing agent. Air was introduced and froth removed at a constant skimming rate over a period of 5 minutes. The rougher concentrate obtained was analyzed for copper and molybdenum and the weight percent of concentrate recovered was determined.

Employing the above procedure, a total of four runs were made evaluating a different collector in each run. Table III indicates the collectors employed and the results obtained.

TABLE III

| Collector | Usage Lbs./Ton | Grade Cu % | Rougher Concentrate Recovery %Cu | %Mo | Wt.% of Ore |
|---|---|---|---|---|---|
| Na Diisobutyldithiophosphate -50% Soln | 0.021 | 6.58 | 82.0 | 72.2 | 5.3 |
| Isobutyl Methylthionocarbamate | 0.021 | 3.78 | 78.2 | 74.6 | 8.7 |
| Na Diisobutyldithiophosphate -50% Soln Plus Isobutyl Methylthionocarbamate (Separate Additions) | 0.0105 0.0105 | 4.08 | 79.7 | 76.1 | 8.0 |
| Na Diisobutyldithiophosphate -50% Soln Plus Isobutyl Methylthionocarbamate (Combined Aqueous Solution) | 0.0105 0.0105 | 4.27 | 86.0 | 80.4 | 8.5 |

EXAMPLE 47

Following the procedure of Example 45 another series of collectors was evaluated. The collectors employed and the results obtained are given in Table IV.

EXAMPLE 48

Following the procedure of Example 45 yet another series of collectors was evaluated. The collectors employed and the results obtained are given in Table V.

The results of examples 46–48 further point out the usefulness of the solutions of the thionocarbamates and dithiophosphates in obtaining optimum recovery of values provided ample testing is conducted to select the proper combination for the ore being treated.

TABLE IV

| Collector | Usage Lbs./Ton | Rougher Concentrate % Cu Recovery | % Mo Recovery |
|---|---|---|---|
| Na Diisoamyldithiophosphate[1] | 0.021 | 82.7 | 77.8 |
| Isobutyl Methylthionocarbamate | 0.021 | 78.2 | 74.6 |
| Na Diisoamyldithiophosphate[1] Plus Isobutyl Methylthionocarbamate (Separate Additions) | 0.0105 0.0105 | 80.2 | 77.0 |
| Na Diisoamyldithiophosphate[1] Plus Isobutyl Methylthionocarbamate (Combined Aqueous Solution) | 0.0105 0.0105 | 82.9 | 80.4 |

[1]As 35% aqueous Solution

TABLE V

| Recovery | Usage Lbs./Ton | Rougher Concentrate % Cu Recovery | % Mo Recovery |
|---|---|---|---|
| Na Diisopropyldithiophosphate[1] | 0.021 | 78.3 | 76.5 |
| Isopropyl Methylthionocarbamate | 0.021 | 82.6 | 77.3 |
| Na Diisopropyldithiophosphate[1]Plus Isopropyl Methylthionocarbamate (Separate Additions) | 0.0105 0.0105 | 80.5 | 80.7 |
| Na Diisopropyldithiophosphate[1]Plus Isopropyl Methylthionocarbamate (Combined Aqueous Solution) | 0.0105 0.0105 | 76.8 | 77.6 |

[1]As 50% Aqueous Solution

The embodiments of the invention in which an exclusive property or privilege is claimed are defined as follows:

1. In the process of recovering copper sulfide values from a copper-bearing ore by froth flotation employing a collector for said copper sulfide values, the improvement which comprises employing as said collector an aqueous solution comprising from about 35 to 50 weight percent of an alkali metal or ammonium salt of a dialkyl dithiophosphate of the formula

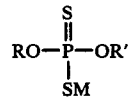

wherein M is an alkali metal or ammonium ion and R and R′ are individually selected from alkyl groups of 2 to 8 carbon atoms and, correspondingly, from about 65 to 50 weight percent of water, said solution containing dissolved therein an N-alkyl O-alkyl thionocarbamate of the structure

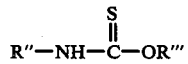

wherein R″ and R‴ are individually selected from alkyl groups of about 1 to 6 carbon atoms, said thionocarbamate being present in an amount sufficient to provide a weight ratio in the range of from about 30:70 to 95:5 of said dialkyldithiophosphate solution to said thionocarbamate, respectively, said collector being present in an amount of from about 0.001 to about 0.1 pounds per ton or ore.

2. The process of claim 1 wherein said thionocarbamate is isopropyl methylthionocarbamate and said dialkyldithiophosphate salt is sodium diisobutyldithiophosphate.

3. The process of claim 1 wherein said thionocarbamate is isobutyl methylthionocarbamate and said dialkyl dithiophosphate salt is sodium diisobutyl dithiophosphate.

4. The process of claim 1 wherein said thionocarbamate is isobutyl methylthionocarbamate and said dialkyl dithiophosphate salt is sodium diisoamyldithiophosphate.

5. The process of claim 1 wherein said thionocarbamate is isopropyl methylthionocarbamate and said dialkyl dithiophosphate salt is sodium diisopropyldithiophosphate.

* * * * *